United States Patent [19]

Rosenthal

[11] Patent Number: 4,889,142

[45] Date of Patent: Dec. 26, 1989

[54] SMOKING ARTICLE AND METHODS OF MAKING THE SAME

[76] Inventor: Walter Rosenthal, 525 West End Ave., New York, N.Y. 10024

[21] Appl. No.: 366,203

[22] Filed: Jun. 9, 1989

Related U.S. Application Data

[63] Continuation of Ser. No. 133,420, Dec. 15, 1987, abandoned.

[51] Int. Cl.[4] ..... A24B 15/28; A24D 1/02

[52] U.S. Cl. ..... 131/309; 131/338; 131/352; 131/368

[58] Field of Search ..... 131/309, 335, 365, 352

[56] References Cited

U.S. PATENT DOCUMENTS

| | | | |
|---|---|---|---|
| 1,983,530 | 12/1934 | Brandenberger | 131/365 |
| 2,158,565 | 5/1939 | Andrews | 131/352 |
| 3,943,940 | 3/1976 | Minami | 131/335 |

*Primary Examiner*—V. Millin

*Attorney, Agent, or Firm*—Schweitzer & Cornman

[57] ABSTRACT

The invention is for a multi-fold improvement for tobacco, including cigarettes, cigars, pipe smoking and other smoking devices by decreasing the health hazards thereof by:

1. Replacing and/or reducing substantially all of the nitrate in cigarette paper by use of an oxidizing agent such as potassium permanganate.
2. Improving the completeness of burning of the relatively poisonous and undesirable components of tar and smoke of cigarette smoke through addition of an oxidizing agent such as potassium permanganate to the cigarette.

Using an oxidizing agent to render non-poisonous certain toxic components in smoking devices and materials including cigarettes, cigars, pipe tobacco and other plant derived ingredients useful and used for smoking.

6 Claims, No Drawings

SMOKING ARTICLE AND METHODS OF MAKING THE SAME

RELATED APPLICATIONS

This application is a continuation of my copending application Ser. No. 133,420, filed Dec. 15, 1987, now abandoned in favor of this application.

FIELD OF THE INVENTION

This invention is a two-step improvement procedure to reduce the health hazards of smoking.

While point No. 1 of the Abstract pertains mainly to cigarettes, point No. 2 refers also to other smoking means such as cigars and pipe tobacco and may include plant leaves and parts.

BACKGROUND OF THE INVENTION

The obligatory warning on cigarette packages "The Surgeon General has determined that cigarette smoking is dangerous to your health" is a fully justified part of anti-smoking educational propaganda to enhance public awareness but its of limited success. Several of the approximately 500 smoke ingredients have proved to be definitely harmful. They often do not have an immediate effect but they represent a so-called chronic poisoning and becomes more or less injurious and even fatal if smoking of more than one pack is continued for 20 to 30 years. Inasmuch as the chances of getting cancer, cardiovascular and respiratory disease are multiplied for smokers in comparison to non-smokers, the strongly irritant effect on all mucous membranes is immediate and is observable in the majority of heavy smokers.

Applicant's U.S. Pat. No. 2985549 (issued 1961) teaches the elimination of nicotine through a unique flavor saving gas reaction process. At that period of time, filter cigarettes come into use in which also the tars are decreased, while health authorities and the public became increasingly conscious of the hazard of lung cancer as demonstrated clearly by statistics on occurrence of this dreaded disease, although this menace occurs less frequently by than cardiovascular disease with its 800,000 yearly fatalities, which is generally perceived by the public as being more frightening and life-threatening.

Filters have an enormous drawback. They detract much from smoking enjoyment, because tar and nicotine are the essential carriers of flavor and taste and the lack of it as the result of filtration is counterproductive. Filtered smoke is often more like insipid steam. Smokers reacted unexpectedly to such loss. They smoke more but statistically consumption stayed constant and even increased. It appears to be difficult and sometimes impossible to wean people from smoking once they are used to it in spite of adverse enlightenment about medical facts. It has been suggested that this reaction probably has to do with "carried over" infantile sucking reflex. In fact, the cigarette has been called the "adult baby bottle." The human desire to smoke is so strong that a great many smokers will not give up or are most reluctant to quit smoking and the oral sensation it affords. It has been estimately recently from government sources that approximately 5 to 6 million dollars is being spent to develop a safer cigarette, because more than 50 million Americans are continuing to smoke.

SUMMARY OF THE INVENTION

The most harmful ingredients of smoke, together with their (harmful) effects on health are listed below:

1. Nicotine and cylic nitrogen compounds, which cause and increase cardiovascular disorders.
2. Tar with its polycyclic hydrocarbons multiplies chances of pulmonary cancer and other respiratory disorders like chronic bronchitis and emphysema.
3. Carbon monoxide competes with oxygenation causing blood starving of all cells and organs of oxygen, and in heavy smokers there may be up to about 80% less oxygenation.
4. Nitrous oxide present from buring of cigarette paper is highly carcinogenic.
5. Furfural, acrolein, isoprenes, phenols and other chemicals in the smoke are highly irritant, and may contribute to all other harmful effects.

It is the main object of this invention to decrease and eliminate the five aforementioned harmful groups of smoke ingredients which result from burning of cigarette paper, filters, tobacco and other smoking means.

It is a further object to provide the best known to date process for reducing and/or elimination of the total toxicity of smoking means including for instance, the toxic components in both tobacco and paper produced during the smoking.

DETAILED DESCRIPTION OF THE INVENTION

In carrying out this invention two steps or procedures are necessary and required to achieve the above objectives.

1. The cigarette paper is treated with diluted solution of at least one strong oxidizing agent which sustains and promotes burning and thus this step replaces nitrate treatment of the paper which produces noxious gases. It has been found that by far the most preferred agent and perhaps the only excellent one is potassium permanganate. This well known chemical is stable in air, having a dark purple color, is odorless, water soluble, non-hygroscopic and does not color paper when used in high dilution. It decomposes below 240° C. evolving nascent oxygen but does not give off any other gases or smell. The resulting manganese oxide is insoluble, innocuous and remains in the ashes. Manganese is in fact, a trace mineral necessary in human and animal nutrition. In dilution as used in smoking means, it has a sweetish and slightly astringent taste. Paper treated with a 1% solution and dried glimmers forth evenly and equally well as nitrated paper.

II. Not only the cigarette paper can be treated but also the filler itself by the same procedure with oxidizing agents. Approximately double the concentration is necessary to produce a beneficial effect to help burning more thoroughly the nicotine and tar especially the polycyclic hydrocarbons components present. Carbon monoxide burns to dioxide and the other hydrocarbons burn simultaneously.

Obviously, the hydrocarbon not containing oxygen will burn faster, easier and more completely than the polycarbohydrates since cellulose is a main ingredient of plants contain oxygen and have a much lower BTU. All toxic chemicals and irritants discussed above are organic compounds and therefore are subject to rapid pyrolysis. Thus, by this means, advanced destruction of all harmful components of smoke is attained.

The following is a typical Example of the oxidative reaction of this invention although it is in no way intended to limit the invention or the claims to the conditions and reactants particularly described below.

EXAMPLES

Tars, nicotine, and noxious gases are present in cigarette smoke at the highest level of 3 mg. per cigarette. This level requires for oxidative destruction about 5 mg. per cigarette of potassium permanganate or its oxidative equivalent. For practical application, the 5 mg. of potassium should be in solution and evenly distributed within the cigarette in order to trap and destroy these toxic substances by the nascent oxygen released. Thus, each cigarette needs for proper and appropriate treatment about one-fourth cc. of a 2% solution of the permanganate. In actual practice, an equal amount of a 1% solution may be sufficient. A saturated aqueous solution at 20° C. containing about 6% by weight of potassium permanganate decomposes just below a temperature of about 240° C. The nascent oxygen released becomes immediately available and reacts to render harmless and non-toxic substantially all the toxic matter in the cigarette including the components in the smoke from the smoking means.

What is claimed is:

1. The process of preparing and using tobacco smoking products to reduce the toxicity thereof, which comprises (a) treating the tobacco by uniformly distributing throughout the tobacco a dilute solution of potassium permanganate (b) during the smoking of the tobacco, causing the progressive decomposition of the potassium, with the release of nascent oxygen into the tobacco smoke stream, as a result of progressive advance through the smoking product of a layer of burning tobacco and the resulting heating of the potassium permanganate to a temperature at least approaching 240° C.

2. A process according to claim 1, further characterized by (a) said smoking product comprising a cigarette including tobacco and a paper wrapping, and (b) said paper wrapping being treated with a dilute solution of potassium permanganate and dried.

3. A process according to claim 2, further characterized by (a) said cigarette being treated with approximately 5 mg of potassium permanganate.

4. A process according to claim 2, further characterized by (a) said cigarette being treated with approximately 0.25 cc of an approximately 2% solution of potassium permanganate.

5. A low toxicity cigarette including tobacco and a wrapping paper, characterized by (a) the wrapping paper being treated with, instead of the customary nitrates, a dilute solution of potassium permanganate (b) the tobacco within said wrapper being treated with a uniformly distributed dilute solution of potassium permanganate, and (c) said potassium permanganate being subject to decomposition, during smoking, with the consequent release of nascent oxygen, by being subjected to a temperature of about 240° C. in a region of the cigarette adjacent to the zone in which the tobacco is burning, (d) whereby tar and nicotine components of the smoke stream are significantly oxidized before reaching the smoker.

6. A cigarette according to claim 5, further characterized by (a) the tobacco and paper of said cigarette containing a uniformly distributed amount of approximately 5 mg of potassium permanganate.

* * * * *